US005337774A

United States Patent [19]

Boyd

[11] Patent Number: 5,337,774

[45] Date of Patent: Aug. 16, 1994

[54] MARINE ENGINE MAINTENANCE

[75] Inventor: Gary P. Boyd, Columbus, Ohio

[73] Assignee: The Smart Corporation, Columbus, Ohio

[21] Appl. No.: 84,150

[22] Filed: Jul. 1, 1993

[51] Int. Cl.[5] ..... F16K 49/00

[52] U.S. Cl. ..... 137/1; 137/334; 137/566; 440/88; 440/113

[58] Field of Search ..... 137/334, 566, 1; 440/88, 113

[56] References Cited

U.S. PATENT DOCUMENTS

| | | | |
|---|---|---|---|
| 3,929,154 | 12/1975 | Goodwin | 137/344 |
| 3,964,731 | 6/1976 | Ernst | 137/563 |
| 4,286,617 | 9/1981 | Bedient | 137/334 |
| 4,298,021 | 11/1981 | Bozemann | 137/334 |
| 4,531,538 | 7/1985 | Sandt et al. | 137/334 |
| 4,869,695 | 9/1989 | Sajdak, Jr. | 440/113 |
| 5,004,042 | 4/1991 | McMorries, IV et al. | 440/88 |
| 5,263,885 | 11/1993 | Montague et al. | 440/88 |

*Primary Examiner*—A. Michael Chambers
*Attorney, Agent, or Firm*—Thomas S. Baker, Jr.

[57] ABSTRACT

A system for use in winterizing/dewinterizing a watercraft marine engine is provided with a closed coolant storage tank having a cooperating pump, with an open coolant recovery tank having a separate cooperating pump, with coolant fluid transfer lines connecting the storage tank pump outlet to the recovery tank and connecting the recovery tank pump outlet to the storage tank, and a control for operating the storage tank pump and the recovery tank pump independently of each other.

6 Claims, 2 Drawing Sheets

MARINE ENGINE MAINTENANCE

FIELD OF THE INVENTION

This invention relates generally to marine engine maintenance, and particularly concerns a method and apparatus for use in the winterization of watercraft engines with antifreeze solutions prior to storage in freezing climes and in the recovery of such solutions from winterized engines prior to their normal operation in non-freezing weather conditions.

BACKGROUND OF THE INVENTION

With the enactment of rigorous environmental protection laws and regulations which serve to minimize the pollution of public bodies of water by contaminants discharged from watercraft it has become desirable to devise new methods and apparatus for use in the winterization and cleaning of certain marine engines with various antifreeze and flushing solutions and in the recovery of antifreeze and flushing solutions from such engines prior to subsequent normal boating operations.

Previously both apparatus and methods have been devised for use in the winterization of water distribution systems incorporated into various recreational vehicles. U.S. Pat. No. 3,929,154 issued to Goodwin, for instance, discloses apparatus for introducing an antifreeze solution from a system tank into various cold-water pipes, hot-water pipes, toilet fixtures, and the like incorporated in a house trailer.

U.S. Pat. No. 4,286,617 issued in the name of Bedient also teaches water system freeze protection apparatus for a recreational vehicle in two different embodiments. One embodiment is operated manually; the other embodiment utilizes an electrical control to accomplish a preferred valving sequence.

Another form of recreational vehicle winterizing apparatus is taught by U.S. Pat. No. 4,298,021 issued to Bozeman. The Bozeman winterizing system appears to be distinguished by the use of key-driven cam surfaces which sequentially contact and actuate a series of electrical switches to accomplish a preferred valving sequence.

Lastly, U.S. Pat. No. 4,531,538 in the name of Sandt et al. teaches a water supply winterizing system for recreational vehicles that includes an installed antifreeze tank. A system pump and ancillary controls operate to flow antifreeze from the system antifreeze tank into various lines during a winterizing mode and to return the antifreeze to the antifreeze tank during a summarizing mode of system operation.

None of the prior art systems are useful for either supplying antifreeze to or recovering antifreeze from marine engines, especially marine engines of the type that utilize open-loop liquid cooling. Such engines typically utilize water received from an intake immersed in the body of water upon which the watercraft is operating to cool the engine. Afterwards the cooling water circulated through the engine is flowed to a discharge and returned to the body of water from which it was drawn.

My invention, when properly utilized in both the "winterizing" and "dewinterizing" phases of watercraft maintenance, properly provides an antifreeze solution to the marine engine to assure that no damage to the engine will occur during winter due to the freezing of water and also permits the recovery of contained antifreeze solution from the engine for possible re-use without having such antifreeze solution pollute any public body of water or waterway.

SUMMARY OF THE INVENTION

To achieve the objectives of my invention I basically provide a recovery tank unit with pump, a supply tank unit with pump, transfer lines interconnecting the recovery and supply tank units, appropriate valving, and an electrical control operable to selectively actuate the recovery tank unit pump and the supply tank unit pump. The recovery tank unit has a top opening so that the propeller, cooling liquid intake, and cooling liquid discharge (or discharges) of the marine engine being "winterized" may be located within the antifreeze solution of proper strength previously flowed into the recovery tank unit from the supply tank unit. The marine engine is then started and run for sufficient time to cause its thermostatic engine control to open and permit the circulation of antifreeze solution coolant throughout the entire engine and recovery tank unit combination. The engine then is immediately shut-down, mist-lubricated, and after withdrawal from partial projection into the recovery tank unit is ready for winter storage. In this "winterizing" procedure the antifreeze solution initially provided in the recovery tank unit is somewhat diluted by the water first contained within the engine.

The same apparatus is employed in the procedure for "summerization" of the marine engine. The propeller, intake, and discharge (or discharges) of the "winterized" marine engine are immersed in water initially provided in the recovery tank unit. The engine is then started and run continuously until the liquid being discharged from the engine discharges is clear. At that time the engine is shut-down, withdrawn from partial projection into the recovery tank unit, and is then ready for normal operation on a public body of water without causing pollution due to ejected antifreeze solution. The previously-contained antifreeze solution removed from the marine engine into the recovery tank unit can now be transferred to the supply tank by appropriate pump actuation for proper disposal or possible reuse.

DETAILED DESCRIPTION

Figure 1:
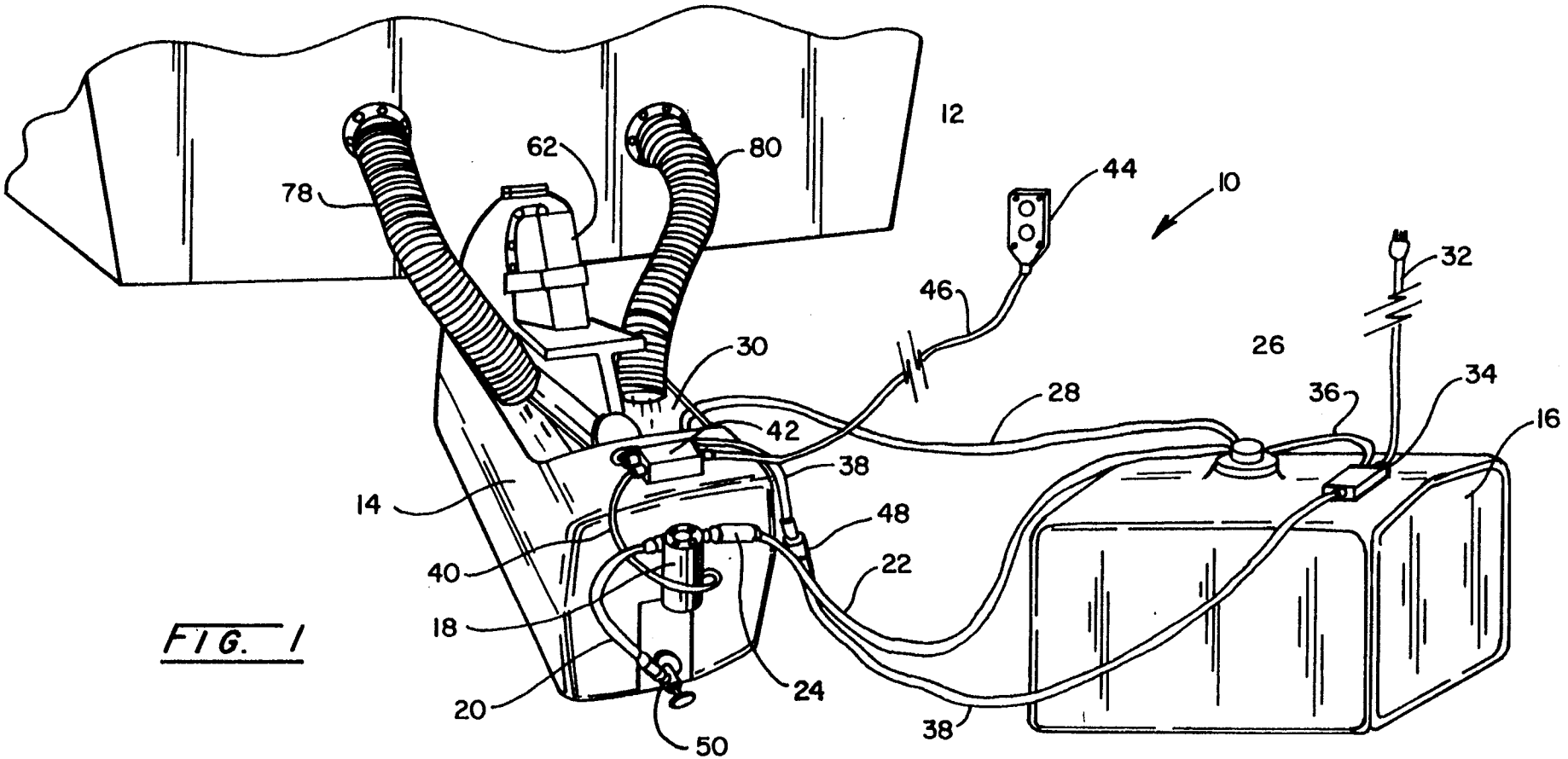
FIG. 1 is a somewhat perspective view of a watercraft stern area showing the marine engine propeller, coolant inlet, and coolant discharge components projected into the recovery tank unit utilized in my invention, the system supply tank unit, and various interconnecting transfer line, pump, valve, and control components.

In FIG. 1 the references numeral (10) is utilized to designate generally the system of this invention cooperating with the stern of a watercraft (12) which has been removed from the water in which it normally operates as during the process of preparing the watercraft for winter storage. System (10) is principally comprised of a recovery tank unit (14) and a supply tank unit (16) in combination with various hereinafter-described interconnecting transfer lines, pumps, valves, and electrical controls. Basically, recovery tank (14) functions to provide antifreeze solution for use in the marine engine of watercraft (12) during a winterization procedure for the watercraft, or alternatively to receive antifreeze solution being discharged from the marine engine of a winterized watercraft during a preparation procedure for normal watercraft operation. Supply tank (16) on the other hand, basically functions to contain either fluid that is to be subsequently transferred to tank unit (14) (winterization) or alternatively to be received from recovery tank unit (14) (dewinterization). During the season for watercraft "winterization", recovery tank (16), which typically has a capacity of approximately 150 gallons, is initially provided with an antifreeze solution of proper strength (e.g., 60% ethylene glycol and 40% water) for subsequent transfer to and use in recovery tank (14). During the season for watercraft "dewinterization" recovery tank (16) receives by transfer such antifreeze solutions as are collected from watercraft in storage tank unit (14) for possible subsequent processing and ultimate reuse, for disposal in an environmentally approved manner, or for any subsequent acceptable non-polluting purpose.

Each of tank units (14 and 16) is provided with a separate pump means and with appropriate fluid transfer lines and electrical controls. More specifically, a recovery pump (18) is externally mounted on one end of recovery tank (14) and is functionally connected to recovery tank (14) by a pump fluid inlet line (20) and to supply tank (16) by a pump fluid discharge line (22). A conventional fluid line quick-disconnect coupling (24) is provided for connecting line (22) to the discharge outlet of pump (18). The discharge end of line (22) preferably passes through an opening in screw cap (26) that is provided for closing supply tank (16).

Supply tank (16) is provided with a non-submersible pump (not illustrated) that is positioned at the tank interior bottom and that is connected to a pump fluid discharge line (28) which extends to the interior of recovery tank (14) through a large top opening (30) that is provided in that tank. Electrical power is supplied to the system pumps through flexible 3-wire electrical supply cord (32), through junction box (34), and then through electrical cord (36) to the supply tank submerged pump or through electrical cords (38 and 40) (as well as junction box 42) to recovery tank pump (18). On-off control of each of the system pumps is effected from hand-held control unit (44) that is connected to junction box (42) through line (46) and to junction box (34) in parallel with line (38). An electrical disconnect (48) is provided in line (38) to facilitate separation of tank unit (14) from tank unit (16) as when moving unit (14) to a distant location for servicing a different watercraft. A manually operable shut-off valve (50) is mounted on tank unit (14) and cooperates with fluid inlet line (20). Although not shown in the drawings, tank unit (14), which preferably is manufactured of a somewhat translucent non-metallic material (e.g., polyethylene), is provided with externally visible markings which indicate acceptable maximum and minimum fluid levels for the contents of the tank. Also, I prefer to provide tank unit (14) with an externally visible fluid temperature gauge (not illustrated).

Figure 2:
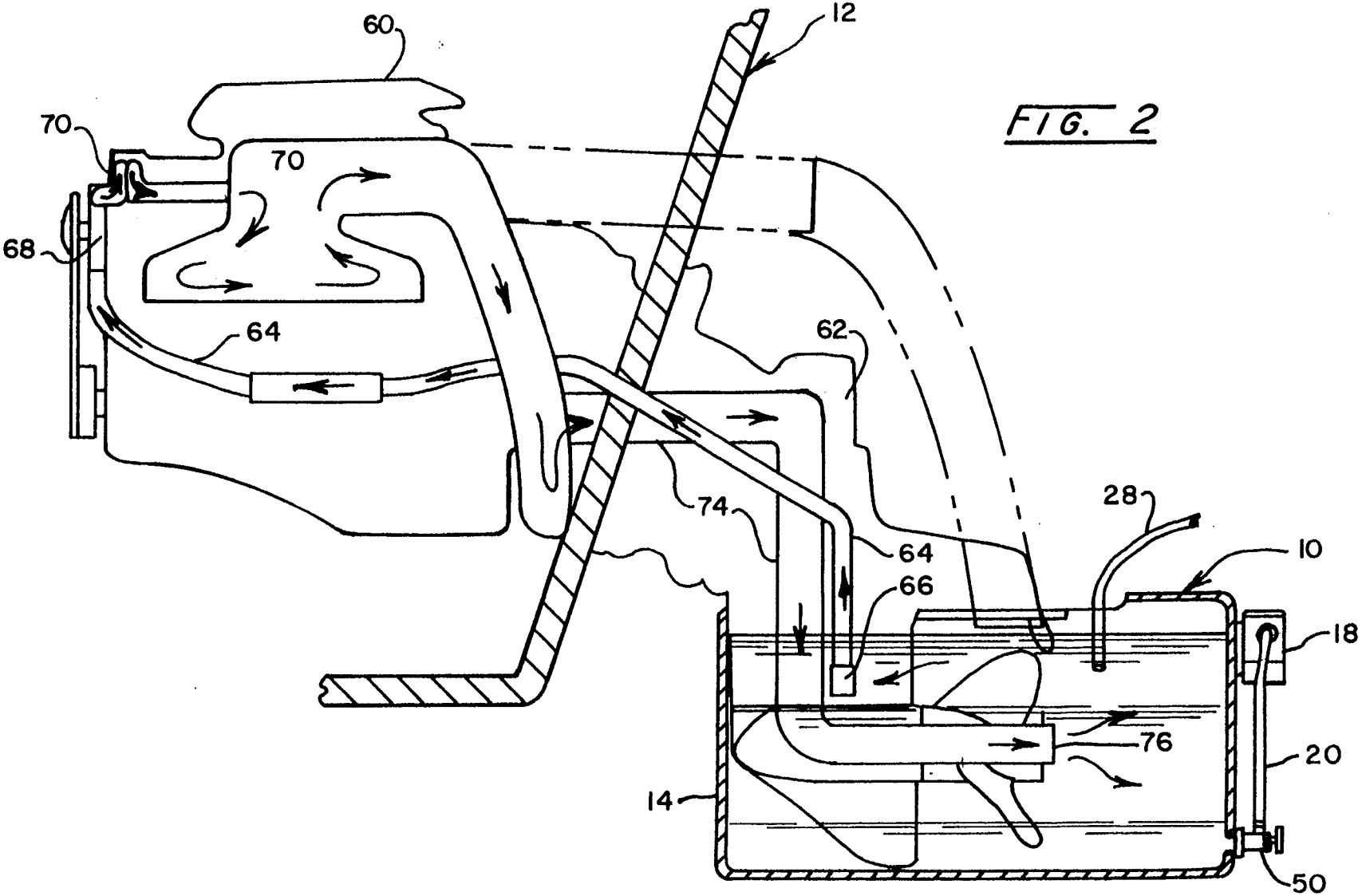
FIG. 2 is a schematic sectional view of a portion of the installation illustrated in FIG. 1.

Both FIGS. 1 and 2 illustrate the manner in which system (10) cooperates with a watercraft (12) and its drive (engine) system (60) for winterization or dewinterization servicing. In such Figures watercraft (12) has been removed from the water as for winter storage and its out-drive section (62) positioned a distance above floor or ground level sufficient to permit tank (14) and its top opening (30) to be placed under the out-drive and elevated so that a portion of engine coolant intake line (64) and its inlet opening (66) is located beneath the surface of the liquid contained in tank (14). When engine system (60) is operating, coolant is drawn into the engine by engine water pump component (68) from tank (14) and through inlet opening (66) and intake line (64). After circulation through thermostatically controlled valve (70), the indrawn coolant is circulated through the composite passageway (72) which schematically represents the coolant passageways in and around the engine block and manifold components of engine system (60). Afterwards the coolant is discharged through discharge line (74) and outlet (76) into the interior of recovery tank (14). Flexible spiral tubes (78 and 80) are readily attached to and removed from the exhaust gas outlets of marine engine (60) and are provided to deflect hot engine exhaust gases downwardly and away from system operating personnel.

The operating procedure for system (10) in connection with the winterization of a watercraft marine engine basically first involves filling 150-gallon supply tank unit (16) with the preferred strength antifreeze solution. Next, the submerged pump in supply tank unit (16) is activated using control (44) and sufficient antifreeze is transferred from tank (16) to recovery tank unit (14) to fill that tank to above its specified fluid operating level minimum. The engine is next started and recovery tank pump means (18) is also started using control (44). With valve (50) in an opened condition, the water coolant initially contained within the cooling system of engine (60) is gradually discharged into tank (14) and after some mixing with the antifreeze in tank (14) is gradually almost entirely transferred into tank (16) causing a slight dilution of the antifreeze in that tank. After engine (60) has been run continuously for a period of time such as 5 to 10 minutes, the engine (60) is stopped and also the system pumps controlled by control unit (44) are stopped. Marine engine (60) is then considered to be properly winterized from the standpoint of residually-contained coolant. It is recommended that after each engine winterization procedure the mixture in tank (16) be checked for both quantity and strength. Any necessary adjustment is then to be completed, as by adding additional full-strength antifreeze, before commencing the winterization of the next watercraft and marine engine to be processed.

The operating procedure for system (10) in connection with the recovery and reclamation of contained antifreeze solution from an engine for dewinterization purposes differs from the winterization procedure in at least one important respect. Supply tank unit (16) is initially filled with fresh water rather than with an antifreeze solution. The submerged pump of unit (16) is next started and fresh water is transferred from unit (16) to the tank of unit (14) until the fluid level in unit (14) is above the prescribed minimum fluid operating level. Next engine (60) is started but it is important that the engine (60) then be run in the dewinterization procedure only until clear fluid is observed to be discharged form outlet (76) of engine system (60). When such occurs, the operation of the supply tank unit pump means is stopped and also the operation of engine (60) is stopped. Next, pump means (18) is activated to transfer the antifreeze solution discharged from the engine to supply tank for ultimate reprocessing such as reclamation or disposal in a non-polluting manner. System (10) may then be prepared for use in connection with the dewinterization of the next watercraft to be processed. Other materials, component shapes, and component sizes may be utilized in the practice of this invention without departing from the spirit or scope of the claims which follow. For example the subject apparatus and method may be utilized to clean marine engines exposed to saltwater where a cleaning or flushing solution is used in place of antifreeze. The cleaning or flushing solution is contained, recovered and reused in the same manner as antifreeze solution.

We claim our invention as follows:

1. In a method of winterizing a watercraft marine engine having outdrive coolant inlet and coolant discharge openings by providing antifreeze solution coolant to engine internal coolant passageways, the steps of:

inserting the marine engine outdrive coolant inlet and discharge openings into an antifreeze solution contained in a recovery tank unit;

starting and operating the watercraft marine engine;

withdrawing antifreeze solution into said watercraft marine engine coolant inlet opening from said recovery tank unit and flowing water coolant from said watercraft marine engine coolant discharge opening into said recovery tank unit for mixing with said antifreeze solution;

continuously transferring the mixed antifreeze solution and water coolant to a storage tank unit and simultaneously transferring less-diluted antifreeze solution from the storage tank unit to the recovery tank unit at substantially equal flow rates until all transferred fluid is of homogeneous concentration;

stopping the operation of the watercraft marine engine and stopping the transferring of fluid to and from the storage tank unit; and withdrawing the watercraft marine engine outdrive coolant inlet and outdrive coolant discharge openings from insertion within said recovery tank unit.

2. In a method of dewinterizing a watercraft marine engine out of water having outdrive coolant inlet and outdrive coolant discharge openings by recovering antifreeze solution contained in engine internal passageways, the steps of:

inserting the watercraft marine engine outdrive coolant inlet and outdrive coolant discharge openings into fresh water contained in a rigid recovery tank unit;

starting and operating the watercraft marine engine; continuing operation of the watercraft marine engine until the fluid being discharged from said engine outdrive coolant discharge opening into the recovery tank unit appears to be clear;

stopping operation of the watercraft marine engine; and withdrawing said watercraft marine engine outdrive coolant inlet and outdrive coolant discharge openings from insertion within said recovery tank unit.

3. In a method of winterizing a watercraft marine engine having outdrive coolant inlet and coolant discharge openings by providing cleaning solution coolant to engine internal coolant passageways, the steps of:

inserting the marine engine outdrive coolant inlet and discharge openings into a cleaning solution contained in a recovery tank unit;

starting and operating the watercraft marine engine;

withdrawing cleaning solution into said watercraft marine engine coolant inlet opening from said recovery tank unit and flowing water coolant from said watercraft marine engine coolant discharge opening into said recovery tank unit for mixing with said cleaning solution;

continuously transferring the mixed cleaning solution and water coolant to a storage tank unit and simultaneously transferring less-diluted cleaning solution from the storage tank unit to the recovery tank unit at substantially equal flow rates until all transferred fluid is of homogeneous concentration;

stopping the operation of the watercraft marine engine and stopping the transferring of fluid to and from the storage tank unit; and withdrawing the watercraft marine engine outdrive coolant inlet and outdrive coolant discharge openings from insertion within said recovery tank unit.

4. An open fluid processing system for use in recovering antifreeze solutions from containment within a watercraft marine engine, and comprising:

a substantially closed storage tank unit containing fresh water and having a pump means for transferring said fresh water from within said storage tank unit to a recovery tank unit;

a recovery tank unit having a top opening through which may be passed the outdrive coolant inlet and outdrive coolant outlet openings of a watercraft marine engine to the tank interior and having a separate pump means for transferring antifreeze solution fluid received from a marine engine outdrive coolant outlet to said storage tank unit;

first fluid transfer line means having an inlet connected to said storage tank pump means and an outlet projected into said recovery tank unit at said recovery tank unit top opening;

second fluid transfer line means having an inlet connected to said recovery unit pump means and an outlet projected into said storage tank unit interior; and control means for selectively activating and deactivating said storage tank unit pump means and said recovery tank unit pump means independently of each other.

5. An open fluid processing system for use in providing antifreeze solution to a watercraft marine engine during a watercraft winterization procedure, and comprising:

a substantially closed storage tank unit containing antifreeze solution of a desired strength and having a pump means for transferring antifreeze solution from within the storage tank unit to a recovery tank unit;

a recovery tank unit having a top opening through which may be passed the outdrive coolant inlet and outdrive coolant outlet openings of a watercraft marine engine to the recovery tank unit interior and having a separate pump means for transferring engine coolant received from said engine outdrive coolant outlet to said storage tank unit;

first fluid transfer line means having an inlet connected to said storage tank unit pump means and an outlet projected into said recovery tank unit at said recovery tank unit top opening;

second fluid transfer line means having an inlet connected to said recovery tank unit pump means and an outlet projected into said storage tank unit interior; and control means for selectively activating and deactivating said storage tank unit pump means and said recovery tank unit pump means independently of each other.

6. An open fluid processing system for use in recovering cleaning solutions from containment within a watercraft marine engine, and comprising:

a substantially closed storage tank unit containing fresh water and having a pump means for transferring said fresh water from within said storage tank unit to a recovery tank unit;

a recovery tank unit having a top opening through which may be passed the outdrive coolant inlet and outdrive coolant outlet openings of a watercraft marine engine to the tank interior and having a separate pump means for transferring cleaning solution fluid received from a marine engine outdrive coolant outlet to said storage tank unit;

first fluid transfer line means having an inlet connected to said storage tank pump means and an outlet projected into said recovery tank unit at said recovery tank unit top opening;

second fluid transfer line means having an inlet connected to said recovery unit pump means and an outlet projected into said storage tank unit interior; and control means for selectively activating and deactivating said storage tank unit pump means and said recovery tank unit pump means independently of each other.

* * * * *